US006920837B2

(12) United States Patent
Keilmann

(10) Patent No.: US 6,920,837 B2
(45) Date of Patent: Jul. 26, 2005

(54) SEWING MACHINE

(75) Inventor: Robert Keilmann, Bensheim (DE)

(73) Assignee: KSL Keilmann Sondermaschinenbau GmbH, Lorsch (DE)

( * ) Notice: Subject to any disclaimer, the term of this patent is extended or adjusted under 35 U.S.C. 154(b) by 17 days.

(21) Appl. No.: 10/389,367

(22) Filed: Mar. 14, 2003

(65) Prior Publication Data

US 2003/0209176 A1 Nov. 13, 2003

(30) Foreign Application Priority Data

Mar. 15, 2002 (DE) ..... 102 11 528

(51) Int. Cl.[7] ..... D05B 19/14; D05B 29/02
(52) U.S. Cl. ..... 112/470.01; 112/221; 112/239
(58) Field of Search ..... 112/470.01, 220, 112/221, 239, 80.4, 302, 276

(56) References Cited

U.S. PATENT DOCUMENTS 4,690,081 A * 9/1987 Castagna et al. ..... 112/276
5,090,341 A * 2/1992 Satterfield ..... 112/80.4
5,596,941 A * 1/1997 Landen ..... 112/239
6,354,233 B1 3/2002 Hulshoff

FOREIGN PATENT DOCUMENTS

DE 198 27 846 A1 12/1999
JP 5023472 2/1993

* cited by examiner

*Primary Examiner*—Peter Nerbun
(74) *Attorney, Agent, or Firm*—McCormick, Paulding & Huber LLP

(57) ABSTRACT

A sewing machine including a sewing machine upper portion with a frame, a needle rod and a sewing foot rod, which rods are guided in the frame for back and forth movement parallel to one another, a rack connected with each of the rods and which racks are driven by separate pinions driven by separate electric motors. These motors and possibly other motors for positioning other parts of the sewing machine are separately controlled independently of one another by a program controlled control unit so that the movement of needle road and of the sewing foot rod can be independently program controlled during a sewing procedure.

7 Claims, 2 Drawing Sheets

SEWING MACHINE

CROSS REFERENCE TO RELATED APPLICATION

Applicant hereby claims foreign priority under 35 U.S.C. § 119 from German Application No. 102 11 528.1 filed Mar. 15, 2002, the disclosure of which is herein incorporated by reference.

FIELD OF THE INVENTION

The invention concerns a sewing machine, including a sewing machine upper portion with a frame, a needle rod and a sewing foot rod, which rods are guided for back and forth movement parallel to one another in the housing, and a drive mechanism for the needle rod and the sewing foot.

BACKGROUND OF THE INVENTION

In customary sewing machines the needle rod and the sewing foot, as well as the thread pulling lever, if applicable, are driven from a common shaft whose rotary movement in each case is converted by a crank or an eccentric drive into a linear back and forth movement of the needle rod and of the sewing foot. This has not only the disadvantage that relatively many individual parts are required and relatively large masses have to be moved, but also that the movement phases of the needle rod and of the sewing foot within a cycle of operation cannot be practically changed. The stroke of the rod is as a rule changeable to a limited degree through an adjustment of the eccentric, but for the adjustment of the stroke the sewing drive has to be interrupted.

From DE 198 27 846 A1 an industrial sewing machine is already known in which the needle rod is linearly moved back and forth by means of an electromagnetic linear motor. By corresponding control of the electromagnets arranged along the needle rod path the needle rod can be moved according to a determined speed or acceleration profile. Along with the considerable expense for the control of the plurality of electromagners, the solution raises above all the disadvantage that the precision of the end positions of the needle rod stroke required for forming a quality stitching can only be obtained with very slow working speeds. Moreover, the drive principle is applicable only for straight line movements and can therefore not without problems be transferred to other kinds of movement, such as for example the rotary movement of a rotating hook.

SUMMARY OF THE INVENTION

The invention has as its object the avoidance of the above-mentioned disadvantages and the provision of a sewing machine of the previously mentioned kind which assures a high flexibility in the control of the movement of the needle rod and of the sewing foot, especially in the adjustment of the needle stroke, while maintaining the highest possible precision.

A principal feature of the inventive solution is that the needle rod and the sewing foot rod are each coupled with a rack, each of which racks meshes with a drive pinion which is drivable by its own program controlled electric motor.

The needle rod and the sewing foot rod can in the solution of the invention be moved back and forth with high precision and entirely independently of one another. Not only can the speed profiles and/or the acceleration profiles be separately established and, as the case may be changed, but also the needle stroke can be changed as may be wished during the sewing operation. This is of special importance for tufting machines and for sewn materials whose material thickness continuously or irregularly changes. In this case it is important that the needle stroke be changed corresponding to the material thickness in order to achieve a clean stitch formation. At the same time, the sewing foot can be pressed against the upper surface of the sewn material for so long as is necessary for the withdrawal of the needle out of the sewn material and for the fixing of the thread in the sewn material, since the movement of the sewing foot is controllable independently of the movement of the needle rod. The sewing speed can be suited without difficulty to the material thickness and to the needle stroke.

Preferably the needle rod and the sewing foot rod are each made of one piece with their associated rack, that is the needle rod and the sewing foot rod can each be provided with teeth forming a rack strip.

In a preferred embodiment of the invention, the needle rod and the sewing foot rod together with at least the drive pinions are arranged on a slide, which slide is slidably guided in the housing parallel to the sewing direction and is adjustable by means of a separate program controlled slide drive. This construction makes possible movement of the needle rod and of the sewing toot rod both in and against the positive sewing direction. Thereby it is possible to move the entire sewing machine continuously along the pre-given sewing line with a suitable manipulator, for example, an industrial robot. An intermittent relative movement between the sewn material and the sewing machine is therefore not necessary, as is customary with industrial sewing machines and which because of the constant acceleration and deceleration limits the working speed. In this case it is important that the movement patterns for the slide control are so generated that neither the needle nor the sewing foot carries out a movement in the sewing direction relative to the sewn material for so long as either of these sewing tools remain in contact with the sewn material.

In the solution according to the invention a thread feeder is also preferably driven by a separate program controlled positioning motor. For example the thread feeder can have a thread-pulling lever arranged on a rack with the rack being in mesh with a pinion driven by a positioning motor. Thereby the delivery of the thread to the needle can also be uncoupled from the movement of the needle itself and can be optimized for the involved sewing process. The thread tension can be adjusted by a thread brake having a program controlled adjustable braking effect.

The sewing machine upper portion can be associated with an under portion with at least one rotating or oscillating hook which is drivable by a separate program controlled motor so that other types of stitches, such as for example a chain stitch, can be carried out.

BRIEF DESCRIPTION OF THE DRAWING

Further features and advantages of the invention will be apparent from the following description, which in connection with the accompanying drawings explain the invention by way of an exemplary embodiment. The drawings are.

DESCRIPTION OF THE PREFERRED EMBODIMENTS

Figure 1:
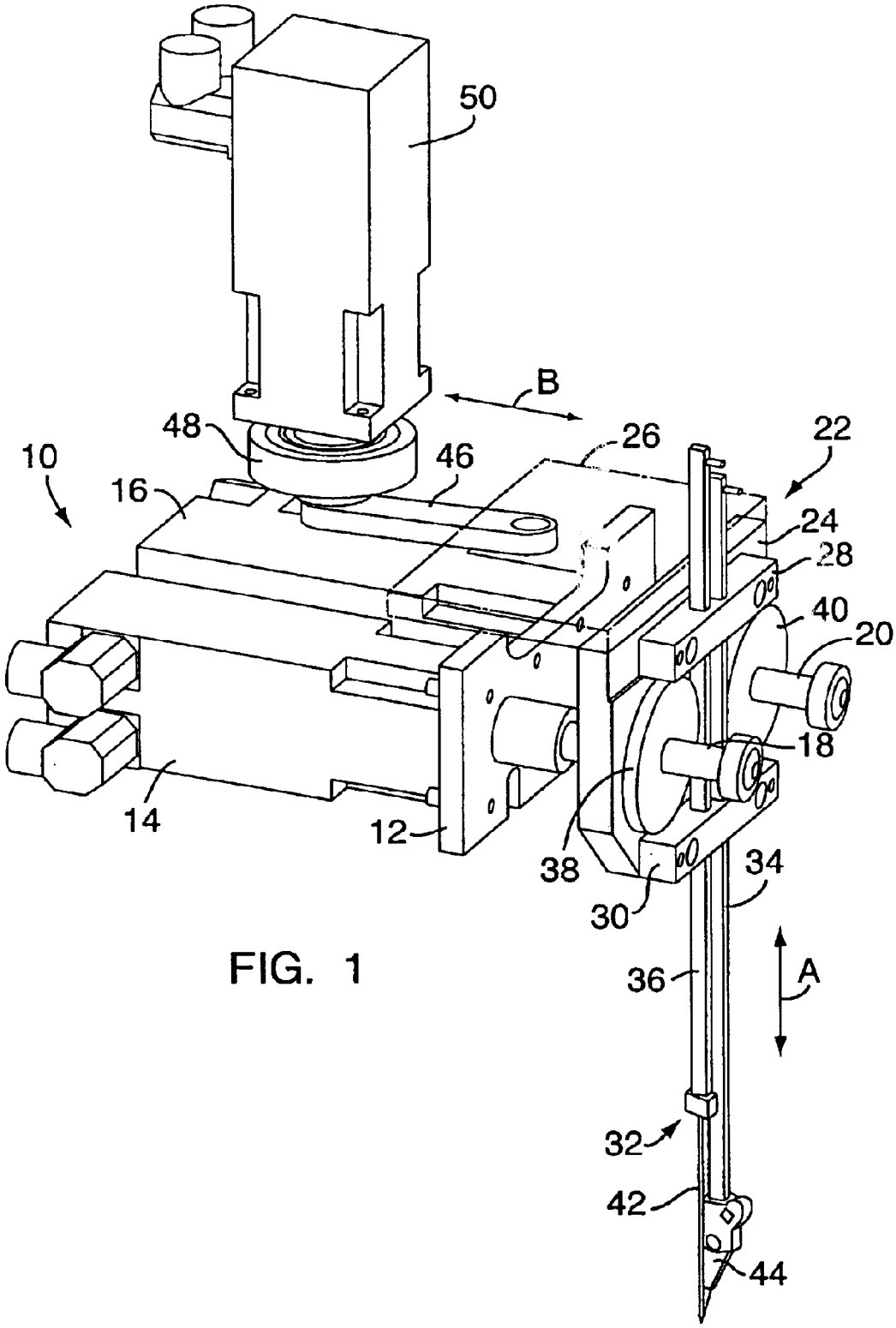
FIG. 1 a schematic perspective illustration of the essential elements of a sewing machine upper portion according to the invention, and FIG. 2 a schematic illustration of the moveable parts of the sewing machine and their drives according to the invention.

FIG. 1 shows a sewing machine upper portion, indicated generally at 10, with a plate 12 which is a part of a frame or housing. On the plate 12 and connected to it by flanges are a first and a second servo motor 14 and 16, whose shafts 18 and 20 extend through and outwardly beyond the plate 12.

Mounted on the frame in a non-illustrated way is slide 22 which includes a support plate 24 parallel to the plate 12 and a plate 26, indicated by broken lines only, perpendicular to the support plate 24 and guided for shifting movement in the direction of the double arrow B. On the support plate 24 are guides 28, 30, and a needle rod 32 and a sewing foot or presser foot rod 34, both guided for up and down movement in the direction of the double arrow A. Each of the rods 32 and 34 has a rack strip 36 standing in meshing engagement with a pinion 38, 40 supported on the support plate 24. The pinions 38 and 40 are axially shiftably arranged on the shafts 18 and 20 and are fixed against rotation relative to the shafts by splines. Therefore, the pinions 38 and 40 can be driven by the motors 14 and 16 and in turn, the needle rod 32 with the needle 42 as well as the sewing foot rod 34 with the sewing or presser foot 44 can be moved up and down.

The plate 26 of the slide 22 is connected by a connecting rod 46 and an eccentric 48 with an electric motor 50 so that the slide 22 is movable back and forth in the direction of the double arrow B relative to the plate 12 of the frame or housing. The motor 50 together with the eccentric 48 and the connecting rod 46 form the so-called needle transport which sees to it that the slide 22 remains stationary relative to the sewn material so long as the needle or the sewing foot is in contact with the sewn material, even if the frame of the sewing machine upper portion moves continuously relative to the sewn material in the sewing direction, that is, parallel to the arrow B.

Figure 2:
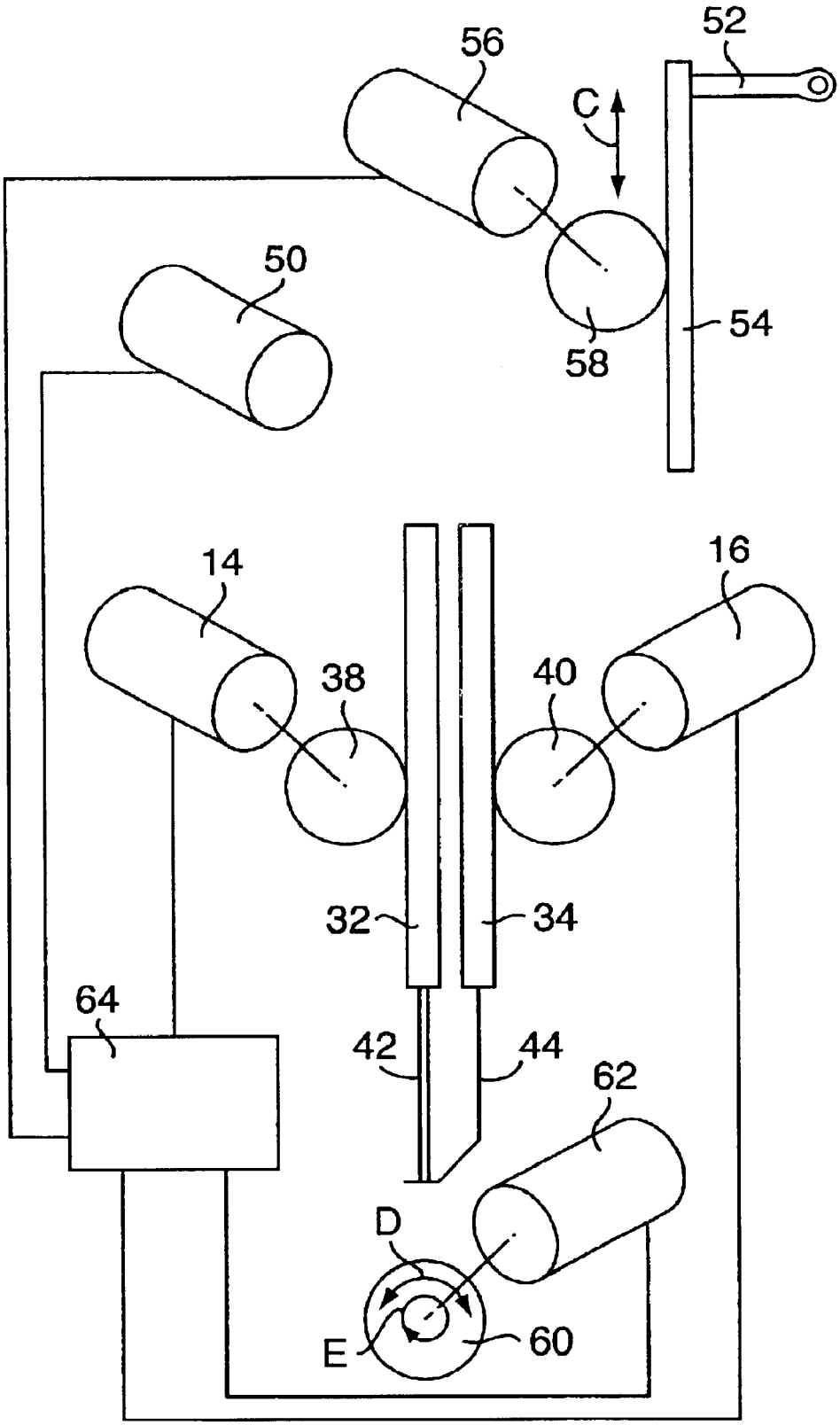

In FIG. 2 the previously described functional elements are shown schematically, with the same parts being provided with the same reference numbers. In addition to the previously mentioned elements, FIG. 2 further shows a thread pulling lever 52, which is fastened to a rack 54 which stands in meshing engagement with a pinion 58 driven by a motor 56 and which can be driven by the pinion 58 up and down in the direction of the arrow C. Further, below the needle rod 32 and the sewing foot rod 34 is arranged a hook 60 which by a motor 62 can be moved back and forth as an oscillating hook or can be turned as a rotary hook, as is indicated by the arrows D and E.

All of the motors 14, 16, 50, 56 and 62 are connected with a control unit 64 by means of which the individual motors can be controlled independently of one another. Therefore each of the stroke, the acceleration, the deceleration, and the stationary times of the needle rod, the sewing foot and the slide are freely programmable: that is, these movements are not positively coupled with one another. All quantities can be programmably controlled during the sewing process and can be changed independently of one another. The same also applies to the drive of the hook 60 and of the thread-pulling lever 52.

The sewing machine upper portion itself can be held on a robot by means of a pivotal device so that the needle can be inserted into the sewn material at an angle relative to the Z-axis. The connector on the robot can also be so formed that the sewing machine upper portion can be quickly exchanged.

What is claimed is:

1. A sewing machine comprising a sewing machine upper portion with a frame, a needle rod and a sewing foot rod which are guided parallel to one another in the frame for back and forth movement, and a drive arrangement for the needle rod and the sewing foot rod, characterized in that the needle rod and the sewing foot rod are each connected with a rack, each of which racks meshes with a drive pinion and each of which pinions is drivable by its own program controlled electric motor, further characterized in that the needle rod and the sewing foot rod together with their associated drive pinion are arranged on a slide, which slide is guided for shifting movement parallel to the sewing direction on the frame and which slide is movable by means of a separate program controlled slide drive.

2. A sewing machine according to claim 1 further characterized in that the sewing machine upper portion has associated with it a lower portion with at least one rotating or oscillating hook, the hook being drivable by a separate program controlled motor.

3. A sewing machine according to claim 1 further characterized in that each electric motor is a servo motor.

4. A sewing machine comprising a sewing machine upper portion with a frame, a needle rod and a sewing foot rod which are guided parallel to one another in the frame for back and forth movement, and a drive arrangement for the needle rod and the sewing foot rod, characterized in that the needle rod and the sewing foot rod are each connected with a rack, each of which racks meshes with a drive pinion and each of which pinions is drivable by its own program controlled electric motor, further characterized by a thread feeder which is drivable by a separate program controlled positioning motor.

5. A sewing machine according to claim 4 further characterized in that the thread feeder has a thread pulling lever arranged on a rack, the rack standing in meshing engagement with a pinion driven by a positioning motor.

6. A sewing machine according to claim 4, further characterized in that the needle rod and the sewing foot rod are each formed as one piece with the associated rack.

7. A sewing machine comprising a sewing machine upper portion with a frame, a needle rod and a sewing foot rod which are guided parallel to one another in the frame for back and forth movement, and a drive arrangement for the needle rod and the sewing foot rod, characterized in that the needle rod and the sewing foot rod are each connected with a rack, each of which racks meshes with a drive pinion and each of which pinions is drivable by its own program controlled electric motor, further characterized by a thread brake with a program controlled adjustable braking effect.

* * * * *